United States Patent [19]

Hale et al.

[11] Patent Number: 4,833,861

[45] Date of Patent: May 30, 1989

[54] SLICED BREAD STACKING APPARATUS

[76] Inventors: Everett D. Hale; Violet E. Hale, both of 301 Pine Ridge, Manitou Springs, Colo. 80829

[21] Appl. No.: 175,988

[22] Filed: Mar. 31, 1988

[51] Int. Cl.[4] ..... B65B 67/04

[52] U.S. Cl. ..... 53/390; 53/255

[58] Field of Search ..... 53/390, 255, 260

[56] References Cited

U.S. PATENT DOCUMENTS

| | | | |
|---|---|---|---|
| 1,188,192 | 6/1916 | Miller | 53/255 |
| 1,788,958 | 1/1931 | Polk . | |
| 1,992,166 | 2/1935 | Beauclerk | 53/260 X |
| 2,031,264 | 2/1936 | Kennebeck | 53/260 X |
| 2,035,259 | 3/1936 | Brustowsky | 53/260 |
| 2,500,361 | 3/1950 | Jordan | 193/43 |
| 2,555,585 | 6/1951 | Fairbank | 53/255 X |
| 2,830,687 | 4/1958 | Baker | 193/21 |
| 3,161,003 | 12/1964 | Grintz | 53/255 |
| 3,952,481 | 4/1976 | Albertsen | 53/392 |

*Primary Examiner*—Willie G. Abercrombie

*Attorney, Agent, or Firm*—Henderson & Sturm

[57] ABSTRACT

A sliced bread stacking apparatus (10) comprising a base unit (11) a vertical support unit (12) and an inclined loaf support unit (13) adapted to suspend and support a loaf of bread (100) at an elevated location during the process of slicing, stacking, and bagging of the individual slices (101) of the loaf of bread.

4 Claims, 1 Drawing Sheet

FIG. 1.
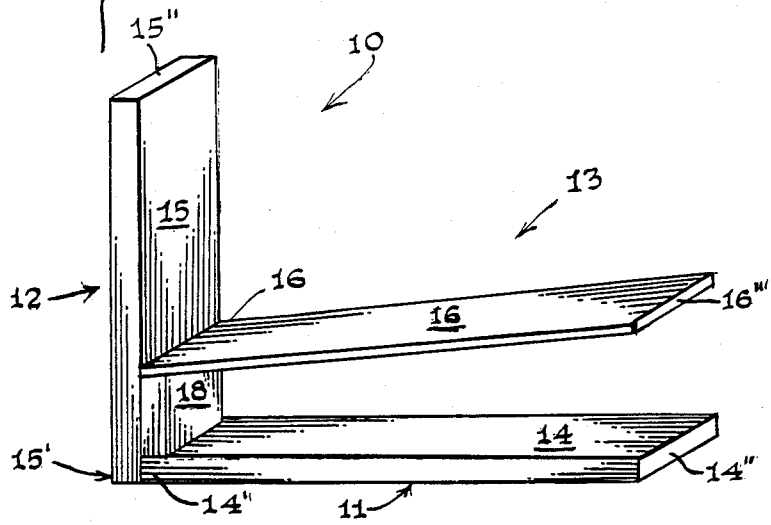
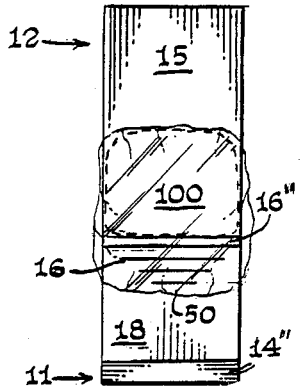
FIG. 3.
FIG. 2.
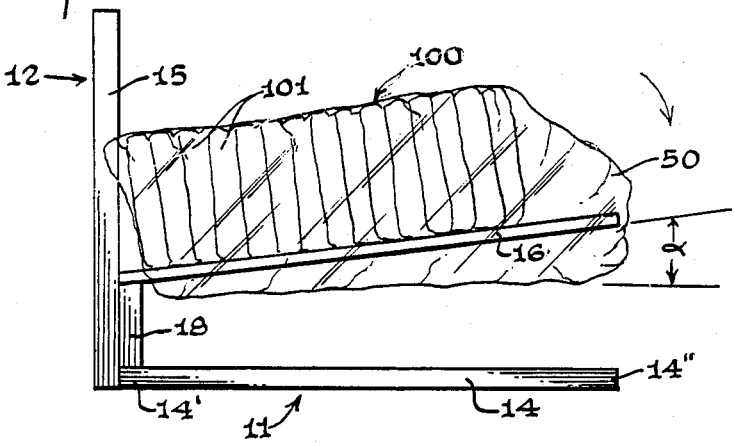
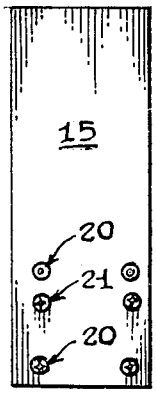
FIG. 4.
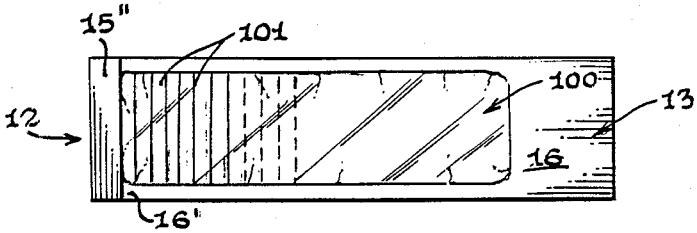
FIG. 5.

SLICED BREAD STACKING APPARATUS

TECHNICAL FIELD

The present invention relates generally to special article packaging assist devices and more specifically to a sliced bread stacking and packaging assist apparatus.

BACKGROUND OF THE INVENTION

This invention was the subject matter of Document Disclosure Program Registration No. 182451 which was filed in the U.S. Patent and Trademark Office on Dec. 8, 1987.

As can be seen by reference to the following U.S. Pat. Nos. 2,830,687; 3,952,481; 1,788,958; and 2,500,361 the prior art is replete with myriad and diverse constructions to assist in the packaging of specialized articles of commerce, including but not limited to, bakery products such as bread or the like.

While all of the aforementioned prior art constructions are more than adequate for the particular purpose and function for which they have been specifically designed, these devices are likewise restricted in their adaptability to perform other operations outside their particular and consequently very limited environment or area of use.

As most home and relatively small volume commercial bakers are all too acutely aware, the task of slicing and packaging loaves of bread is a burdensome chore, primarily due to the inherent tendency of the individual slices of bread to fall away from the uncut portion of the loaf in an unaligned random and sometimes haphazard fashion. As a consequence of the foregoing situation the individual slices have to be realigned into a quasi-uniform stack of slices, that at least vaguely resembles the configuration of the unsliced loaf, prior to the insertion of the stacked slices into a package.

Obviously there has existed a longstanding need for a bread slicing, stacking, and packaging assist apparatus that would eliminate the aforementioned problems for bakers; and, this objective was considered to be of paramount importance in the development of the apparatus that forms the basis of the present invention.

BRIEF SUMMARY OF THE INVENTION

Briefly stated, the sliced bread stacking apparatus that forms the basis of the present invention comprises a base unit; a vertical support unit; and an angled support unit wherein the vertical support unit is operatively secured to the base unit, and the angled support unit is operatively attached to the vertical support unit.

In the preferred embodiment of the invention that will be described in greater detail further on in the specification, the angled support unit comprises a generally rectangular loaf support member that is disposed at an upwardly inclined angle intermediate the ends of the vertical support unit; wherein, the loaf support member is dimensioned to project beyond the periphery of a loaf of bread to provide support to the bottom of the loaf of bread as it undergoes the slicing process.

In addition, the vertical support unit projects above the captive end of the loaf support member to provide a vertical support to one end of the loaf of bread as it undergoes the slicing process. Furthermore, the free end of the loaf support member is vertically spaced from the base unit; such that a package may be slipped into an enveloping relationship with the underside of the loaf support member and the sliced loaf. Thereafter, the sliced loaf may be introduced into the package in a neatly stacked fashion by relative movement of the loaf support member with respect to both the loaf and the package.

BRIEF DESCRIPTION OF THE DRAWINGS

These and other objects, advantage, and novel features of the invention will become apparent from the detailed description of the best mode for carrying out the preferred embodiment of the drawings which follows; particularly when considered in conjunction with the accompanying drawings, wherein:

FIG. 1 is a perspective view of the sliced bread stacking apparatus;

FIG. 2 is a side plan view of the apparatus;

FIG. 3 is a front plan view;

FIG. 4 is a top plan view; and,

FIG. 5 is a rear plan view.

BEST MODE FOR CARRYING OUT THE INVENTION

As can be seen by reference to the drawings and in particular to FIG. 1, the sliced bread stacking apparatus that forms the basis of the present invention is designated generally by the reference numeral (10). The sliced bread stacking apparatus (10) comprises in general: a base unit (11); a vertical unit (12); and a stacking unit (13). These units will now be described in seriatim fashion.

As shown in FIGS. 1 and 2, the base unit (11) comprises a elongated horizontally disposed relatively flat base member (14) having a generally rectangular configuration; and, the vertical unit (12) comprises an elongated vertically disposed relatively flat support member (15); wherein, one end (14') of the base member (14) is operatively secured to the lower end (15') of the vertical support member (15) in a generally perpendicular fashion.

As can also be seen by reference to FIGS. 1 and 2, the stacking unit (13) comprises an elongated generally rectangular loaf support member (16) which is operatively secured on one end (16') to, and disposed intermediate the upper (15'') and lower (15') ends of the vertical support member (15). In addition, the loaf support member (16) is disposed at an angle "$\alpha$" relative to the base member (14); wherein, the angle "$\alpha$" less than 45°. As a consequence, the free end 16'') is at a higher elevation than the captive end (16') of the loaf support member (16); such the free end (16'') of the loaf support member (16) is spaced a substantial distance above the free end (14'') of the base member (14), for reasons that will be explained in greater detail further on in the specification.

Still referring to FIGS. 1 and 2, it can be seen that in the preferred embodiment of the invention the sliced bread stacking apparatus (10) is further provided with a stiffening member (18) that is disposed intermediate the captive ends (14', 15', and 16') of base (14) vertical support (15) and loaf support (16) members; wherein, the stiffening member (18) is intended to supply rigidity to the overall apparatus (10) while also providing cantilever support for the captive end (16') of the loaf support member (16) in a well recognized manner.

As can best be appreciated by reference to FIGS. 2, 3, and 5, the loaf support member (16) is dimensioned such that the periphery of the loaf support member (16) will project beyond the periphery of at least the bottom of a loaf of bread (100); wherein, the top of the loaf support member (16) serves as a cutting board surface, that will allow the loaf of bread to be cut into a plurality of individual slices (101). In addition, the upper portion of the vertical support member (15) projects a sufficient distance above the captive end (16') of the loaf support member (16) as to serve as a vertical support surface for the inner end of the loaf of bread (100).

Due to the angled inclination of the loaf support member (16) and the presence of the vertical support member (15), the individual slices of bread will be maintained in the same general configuration as the unsliced loaf of bread (100) as the cutting process progresses to its conclusion.

Turning now to FIG. 4, it can be seen that securing means (20) are provided for operatively connecting the vertical support member (15) to the base member (14), the loaf support member (16) and the optional stiffening member (18) and vice versa; and, while the securing means (20) are depicted as fasteners (21) such as mails, screws, or the like; it is also to be understood that any suitable fastening means (20) such as adhesives, etc. may be employed in keeping with the teachings of this invention.

Returning once more to FIGS. 2 and 3, it can be seen that the packaging function of the apparatus (10) is accomplished by slipping the mouth of a package (50) in an enveloping relationship over the loaf support member (16) and the sliced loaf of bread (100). At this juncture the loaf of bread within the wrapper or package (50) is held with both hands and slid off of the apparatus (10). The package (50) is then held in one hand and twirled with the other hand, whereupon a plastic tie or the like (not shown) is used to seal the mouth of the package (50) in a well recognized manner.

Having thereby described the subject matter of this invention it should be apparent that many substitutions, modifications, and varations of the invention are possible in light of the above teachings. It is therefore to be understood that the invention as taught and described herein is only to be limited to the extent of the breadth and scope of the appended claims.

We claim:

1. A sliced bread stacking apparatus for use with a loaf of bread and a package wherein the sliced bread stacking apparatus consists of:

an elongated horizontal base unit;

a vertical support unit operatively secured on one end to the base unit; and, a loaf support unit fixedly secured at an upwardly inclined angle intermediate the ends of said vertical support unit; wherein the loaf support unit has a captive end and a free end: and, wherein the loaf support unit is secured to the vertical support unit, such that the loaf support unit is disposed at an angle $\alpha$ relative to the base unit, and the value of the angle $\alpha$ does not exceed 45°.

2. The apparatus as in claim 1 wherein the loaf support unit comprises:

an elongated generally rectangular loaf support member which is dimensioned such that the periphery of the loaf support member will project beyond the periphery of at least the bottom of a loaf of bread.

3. The apparatus as in claim 2 wherein the upper portion of the vertical support unit projects a sufficient distance above the captive end of the loaf support unit so as to provide a vertical support surface for one end of the loaf of bread.

4. The apparatus as in claim 4 further comprising a stiffening member disposed intermediate the juncture of the base unit, the vertical support unit and the loaf support unit.

* * * * *